United States Patent [19]

Smythe

[11] Patent Number: 4,732,777

[45] Date of Patent: Mar. 22, 1988

[54] ELECTROSTATIC COATING APPARATUS AND PROCESS

[75] Inventor: Kenneth R. Smythe, Farnborough, United Kingdom

[73] Assignee: Sale Tilney Technology PLC, United Kingdom

[21] Appl. No.: 937,563

[22] Filed: Dec. 3, 1986

[30] Foreign Application Priority Data

Dec. 4, 1985 [GB] United Kingdom ..... 8529932

[51] Int. Cl.[4] ..... B05D 1/04

[52] U.S. Cl. ..... 427/27; 118/708; 118/629

[58] Field of Search ..... 118/683, 684, 629, 708, 118/630, 631, 632, 633; 427/27

[56] References Cited

U.S. PATENT DOCUMENTS

| | | | |
|---|---|---|---|
| 1,404,200 | 1/1922 | Grush | 118/683 |
| 2,509,277 | 5/1950 | Ransburg et al. | 118/631 X |
| 2,877,137 | 3/1959 | Juvinall et al. | 118/630 X |
| 3,048,498 | 8/1962 | Juvinall et al. | 118/631 X |
| 4,164,001 | 8/1979 | Patnaude | 118/684 X |

*Primary Examiner*—Shrive P. Beck

*Attorney, Agent, or Firm*—Handal & Morofsky

[57] ABSTRACT

An electrostatic coating apparatus is described comprising an applicator, means for supplying liquid to the applicator at a controlled rate, means for establishing an electrostatic field between the applicator and a target substrate to be coated and control means providing an output signal to the liquid supply means for setting the rate at which liquid is supplied to the applicator, the said control means also providing an output signal to the field establishing means which, in operation, sets the magnitude of the applied field, the said output signals being such that the applied field is varied in accordance with any change in the rate of supply of liquid to the applicator.

8 Claims, 3 Drawing Figures

ELECTROSTATIC COATING APPARATUS AND PROCESS

The present invention relates to an electrostatic coating apparatus that includes an electrostatic applicator, e.g. a coating blade or a rotary atomiser, and in particular the invention is concerned with an apparatus that permits a wider range of coating weights (or thicknesses) that was hitherto possible.

Electrostatic coating apparatuses are well-known and are used for applying a liquid, e.g. oil or paint, onto a conductive substrate by maintaining an electrostatic field between the substrate and the applicator. When liquid is supplied to the applicator, the field breaks the liquid up into charged droplets which are drawn by the field towards the substrate. In this way, an even coating of the liquid is produced on the substrate. The electrostatic field is usually produced by maintaining the substrate at zero potential, i.e. it is earthed, and charging the applicator to a fixed potential that produces the desired field; the potential is set according to the nature of the liquid to be applied and in particular to the resistivity of the liquid. The substrate is usually conveyed past the coating device, which is in a fixed location, by an earthed conveyor.

The amount of liquid applied to the substrate, which is generally known as the 'coating weight' and is measured in $g/m^2$, can be changed by varying the volume of liquid supplied by a metering pump to the applicator. The metering pump is driven by a motor whose speed is regulated according to the desired coating weight to be applied and according to the speed that the conveyor moves the substrate past the coating apparatus. In this way, the pump is automatically adjusted to provide the correct amount of liquid for the rate of travel of the substrate past the coating device. The potential applied to the applicator is pre-set by a manually-operated external potentiometer.

As stated above, the coating weight can be altered by varying the amount of liquid fed to the applicator but this is only true within a limited range because the rate at which liquid can be discharged from an applicator is itself limited and, outside a certain range, the discharge rate cannot be altered by supplying more (or less) liquid to the applicator: if the rate at which liquid is supplied to the blade is too high, it floods and operation is both messy and wasteful and furthermore the droplets produced are large, which leads to a nonuniform coverage of the target substrate; if, on the other hand, the rate of liquid supply to the applicator is too low, operation becomes intermittent. In the range between these two extremes, the operation is generally satisfactory. In the case of an electrostatic blade, the discharge rates can typically be varied between 0.5 and 6 ml of liquid per cm of blade length per minute (ml/cm blade length/-min).

We have now discovered that the range of discharge rates (and therefore the range of coating weights) can be greatly increased if the field between the applicator and the target substrate is set in accordance with the rate of supply of liquid to the applicator. Using the present invention, we have achieved discharge rates from a given blade of between 0.03 and 15 ml/cm blade length/minute. Thus, the ratio of the highest possible discharge rate to the lowest possible rate that could be achieved hitherto was approximately 30:1 whereas the same ratio using the present invention is 500:1; such a increase is not only surprising but also it is highly advantageous to modern industry, since it allows greater flexibility in the coating weight that can be applied and in particular it permits very low coating weights to be applied. Hitherto, the connection between the field applied and the amount of liquid supplied was not appreciated.

The target substrate is not always moved past the applicator at a steady rate and, for example when coating steel strip with oil in a steel mill, the strip starts at a standstill and is quickly accelerated to a desired steady speed. However the leading part of the strip is not always properly coated because its speed past the applicator, and therefore the oil delivery rate, is lower than that required to achieve an acceptable spray pattern at the single fixed potential. The process of the present invention overcomes this problem because of the broadening of the range of rates at which liquid can be discharged satisfactorily from the applicator.

According to the present invention, there is provided an electrostatic coating apparatus comprising an applicator, means for supplying liquid to the applicator at a controlled rate, means for establishing an electrostatic field between the applicator and a substrate to be coated and control means providing an output signalto the liquid supply means for setting the rate at which liquid is supplied to the applicator, the said control means also providing an output signal to the field establishing means which, in operation, sets the magnitude of the applied field, the said output signals being related to each other so that the applied field is varied in accordance with any change in the rate of supply of liquid to the applicator.

The output signal to the liquid supply means is advantageously the same signal as is fed to the field establishing means.

The control means may comprise means for measuring the relative speed between the substrate and the applicator, in which case the control means preferably sets the output signals in accordance with the speed measured by the measuring means so as to apply to the target substrate a uniform coating weight irrespective of the relative speed between the substrate and the applicator.

As stated above, the field between the applicator and the target substrate is usually produced by applying a potential to the applicator and maintaining the target at earth potential and the following discussion will be directed to such an arrangement although it should be borne in mind that the invention is not limited to this arrangement and the field may be established by applying potential to the substrate instead of, or in addition to, the applicator.

In many cases, it is sufficient for the field establishing means to provide to the applicator a fixed base potential and, on top of the base potential, a flow-dependent potential that is directly or indirectly proportional to the output of the control means. Other arrangements for setting the potential of the applicator can of course be used. It is not necessary for the applicator potential to be directly proportional to the rate at which liquid is supplied to the applicator and it is possible for these two parameters to be indirectly proportional to each other; any desired relationship between the applicator potential and the rate of supply of liquid to the applicator can be used, e.g, the graph of applicator potential versus liquid supply rate may be curved. This can be achieved using analog shaping circuits or digital processing using a programmable read only memor (PROM), e.g, an erasable programmable read only memory (EPROM). It is evident that the liquid and potential supplied to the applicator may be controlled by digital or by analog circuits.

An electrostatic coating apparatus in accordance with the present invention will not be described with reference to the accompanying drawings in which.

Figure 1:
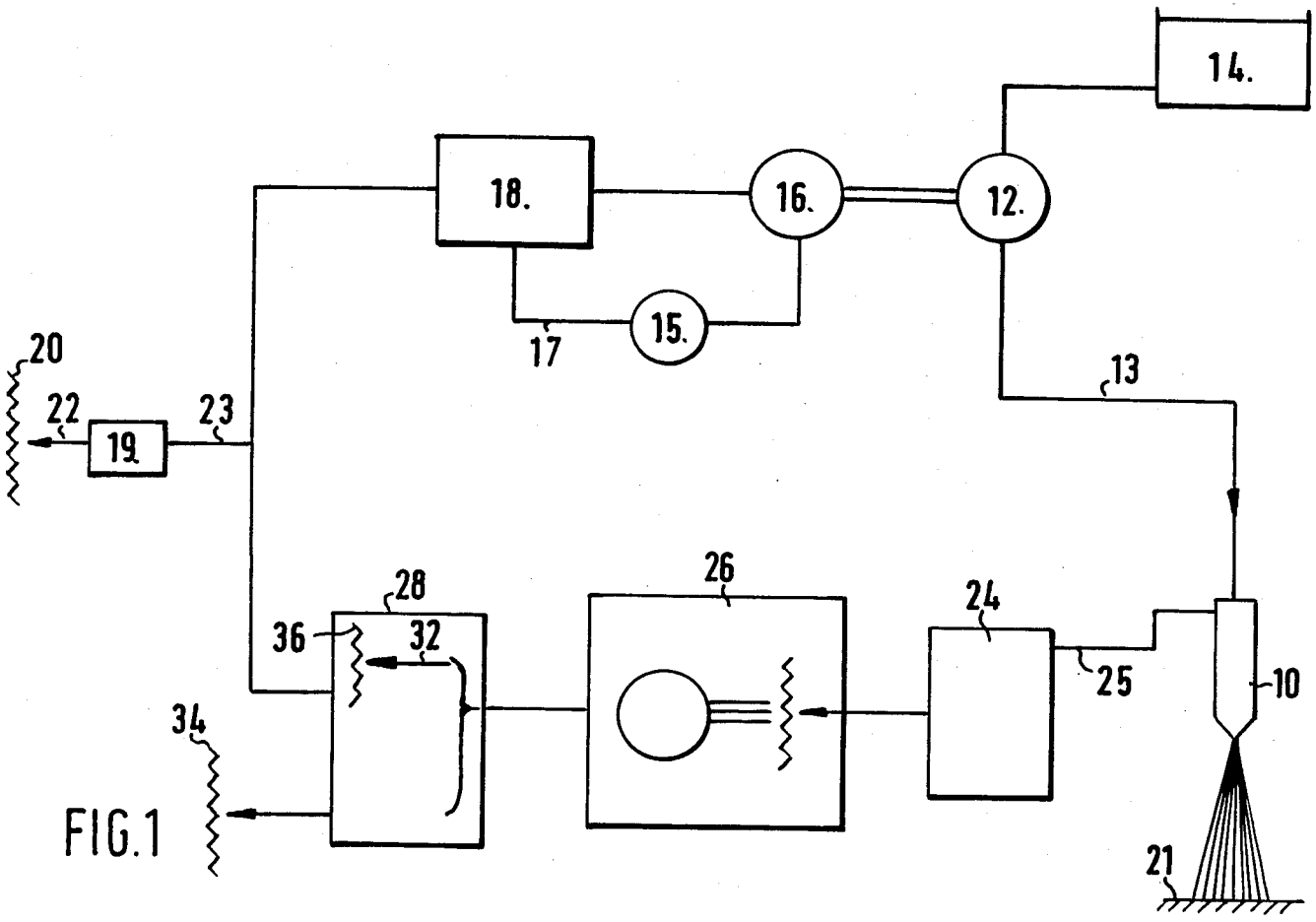
FIG. 1 is a schematic drawing of the apparatus.

Referring to FIG. 1, the electrostatic coating apparatus has a coating blade 10, a pump 12 for supplying liquid from a reservoir 14 along line 13 to the blade, a motor 16 for driving the pump, a speed controller 18 that governs the speed of motor 16 and therefore the amount of liquid supplied to the blade, a device 19 measuring the speed that a target substrate 21 is moved past the blade 10 and a computer- or manually-controlled potentiometer 20 that has an output 22. A tachometer 15 measures the speed of the motor 16 and is connected via a feedback loop 17 to the speed controller 18. The coating weight is set on potentiometer 20 and its output 22 is modified by speed monitoring device 19 according to the speed of the substrate 21 to produce an output 23 that is fed to the speed controller 18 and that controls the rate of supply of liquid to the blade 10. By using the device 19 to modify output 22, the amount of liquid supplied to the coating blade 10 is adjusted automatically if the speed of the substrate 21 is altered and therefore a uniform coating weight is applied to each substrate irrespective of the rate at which it moves past the blade.

Electric power is supplied to the blade along conductor 25 by a high voltage power unit 24 consisting of a transformer and a voltage doubler circuit; the potential supplied to the power unit 24 is set by a voltage stabilizer unit 26 of the motorised auto transformer type which in turn is governed by the output of a voltage tracking unit 28. The voltage tracking unit is an addition circuit whose output voltage is the sum of the output voltage of an external potentiometer 34 and a voltage 32 that is proportional to the output 23 of the speed monitoring device 19. The magnitude of the voltage 32 is set by a potentiometer 36, that is to say, the relationship between the output 23 and the output 32 is set by potentiometer 36.

The potentiometer 20 is set to provide the desired coating weight on the target substrate and the voltage applied to the blade 10 is then set automatically to provide an optimum spray pattern. If it is desired to change the coating weight, the potentiometer 20 is adjusted to alter output 22 and hence output 23, which in turn changes the volume of liquid supplied to blade 10. Simultaneously the output 32 is changed which thereby adjusts the potential of the blade 10 to the optimum value for the new coating weight.

Figure 2:
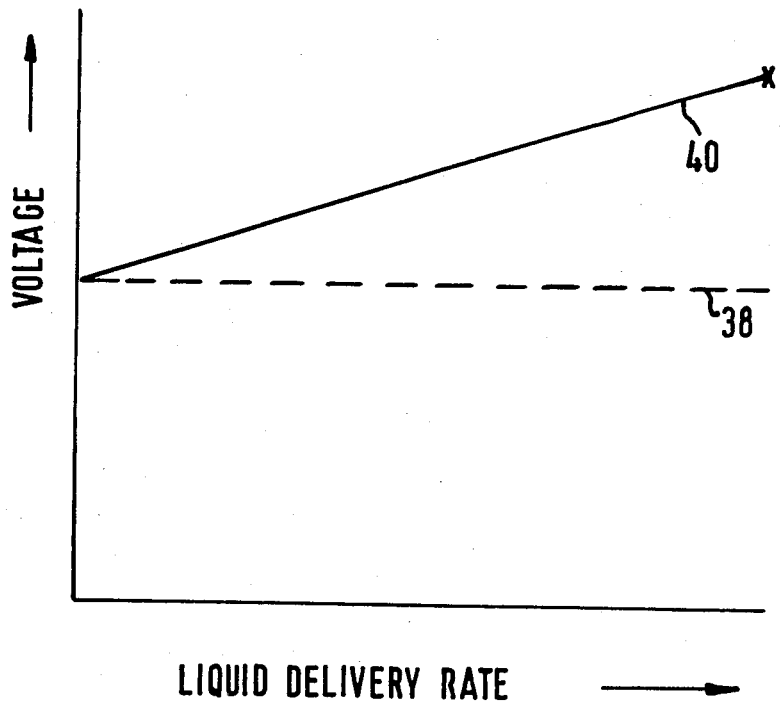
FIG. 2 is a graph showing the variation of the potential of the applicator with changing liquid delivery rates.

Generally, the blade potential is increased when the rate of supply of liquid to the blade increases, which in turn increases when the desired coating weight is increased and/or when the substrate 21 is moved faster past the blade 10. This is illustrated graphically in FIG. 2. The base voltage (shown by the dashed line 38) supplied to the blade 10 is derived from the setting of potentiometer 34 and the variation in voltage with the liquid supply rate to blade 10 derived from output 23 is added to the base potential to provide the potential that is applied to the applicator shown by solid line 40; the slope of the line 40 is set by potentiometer 36.

Although the control circuits described in connection with FIG. 1 have been analog, it is, of course, possible for them to be digital. The relationship between the liquid supply rate and the applied voltage shown in FIG. 2 need not be linear and may be any shape, e.g. curved, that is found to provide the optimum field for a given coating weight. Such a departure from a linear relationship may be achieved using analog suitable shaping circuits instead of unit 28 or it may be achieved digitally using an EPROM.

Instead of the illustrated blade 10, a rotary atomizer may be used.

Figure 3:
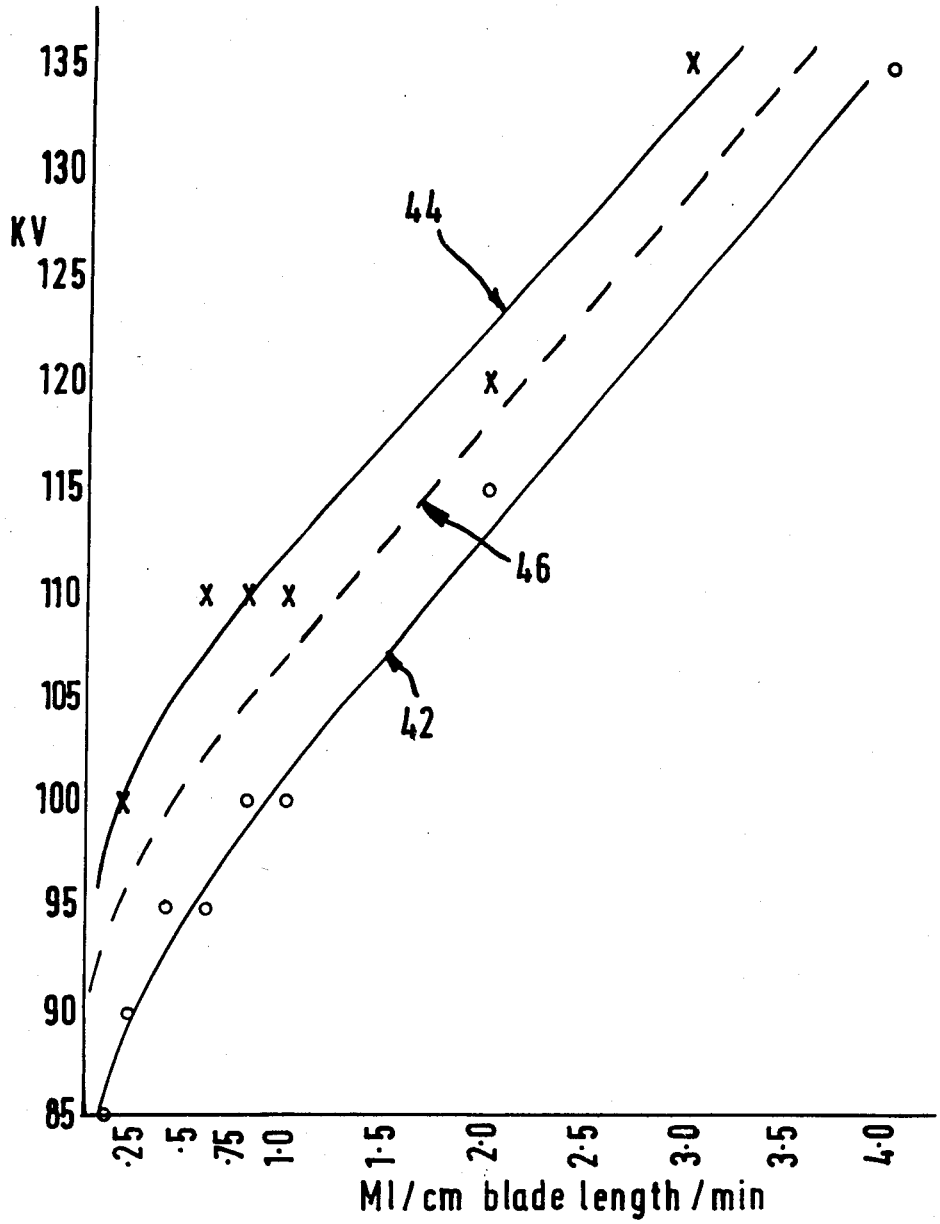
FIG. 3 is a graph showing the variation in the discharge rate from a blade against the applied voltage.

The relationship between the rate at which liquid is discharged from a coating blade and the applied voltage is shown in FIG. 3. The tests were conducted at 20° C. using a blade as described inour copending patent application Ser. No. 898,260 of J. P. Grenfell filed Aug. 20, 1986 for "Electrostatic coating blade and method of electrostatic spraying" and assigned to Sale Tilney Technology PLC, the assignee herein and oil of type Nalco. XL 174. In FIG. 3, the discharge rate is given in ml/cm of blade length/minute along the x-axis and the applied voltage in KV along the y-axis. The points at which flooding occurred are shown as circles while the points at which discharge became intermittent are shown by crosses; these points are plotted as lines 42 and 44 respectively while line 46 shows the optimum voltage/discharge rate.

It is clear from FIG. 3 that there is a correlation between the discharge rate and the applied voltage which was not recognized hitherto.

If one were to use a fixed voltage of, say, 115 KV, it can be seen from FIG. 3 that the range of discharge rates that could be applied is limited to between 1.5 and 2.2 ml/cm blade length/minute whereas by varying the voltage in accordance with the discharge rate, a much broader range of discharge rates can be achieved.

I claim:

1. An electrostatic coating apparatus comprising an applicator, means for supplying liquid to the applicator at a controlled rate, means for establishing an electrosatic field between the applicator and a substrate to be coated and control means providing an output signal to the liquid supply means for setting the rate at which liquid is supplied to the applicator, the said control means also providing an output signal to the field establishing means which, in operation, sets the magnitude of the applied field, the said output signals being related to each other so that the applied field is varied automatically in accordance with any change in the rate of supply of liquid to the applicator.

2. An apparatus as claimed in claim 1, wherein the output signals to the liquid supply means and to the field establishing means are a single output signal supplied to both the liquid supply means and the field establishing means.

3. An apparatus as claimed in claim 1, wherein the control means includes means for measuring the relative speed between the substrate and the applicator.

4. An apparatus as claimed in claim 3, wherein the control means sets the output signals in accordance with the speed measured by the measuring means so as to apply to the substrate a uniform coating weight irrespective of the relative speed between the substrate and the applicator.

5. An apparatus as claimed in claim 1, wherein the field establishing means provides to the applicator a fixed base potential and, on top of the base potential, a flow-depending potential that is directly or indirectly proportional to the output of the control means.

6. An apparatus as claimed in claim 1, wherein a graph of the applicator potential versus liquid supply rate is curved or straight.

7. A process of electrostatically coating a substrate with a liquid, which process comprises feeding liquid to an electrostatic applicator, establishing a field between the substrate and the applicator, adjusting the rate at which liquid is fed to the applicator and automatically adjusting the field according to the change in the rate at which liquid is supplied to the applicator.

8. A process as claimed in claim 7, which includes moving the substrate past the applicator and setting the rate which the liquid is supplied to the applicator in accordance with the speed of the substrate past the applicator.

* * * * *